United States Patent [19]

Giede et al.

[11] 4,302,354

[45] Nov. 24, 1981

[54] MIXTURES OF VICINAL AMINOALKANOLS, PROCESS OF PREPARATION, AND THEIR APPLICATION AS CORROSION INHIBITORS

[75] Inventors: Wolfgang Giede, Hilden; Karlheinz Koch, Haan; Gerhard Kolaczinski, Dusseldorf-Oberkassel; Wolfgang Rupilius, Dusseldorf; Werner Stein, Erkrath-Unterbach, all of Fed. Rep. of Germany

[73] Assignees: Henkel Kommanditgesellachaft auf Aktien, Düsseldorf-Holthausen; Deutsche Gold- und Silber-Scheideanstalt, Frankfurt am Main, both of Fed. Rep. of Germany

[21] Appl. No.: 683,322

[22] Filed: May 5, 1976

[30] Foreign Application Priority Data

May 7, 1975 [DE] Fed. Rep. of Germany ..... 2520267

[51] Int. Cl.[3] ..... C09K 3/00

[52] U.S. Cl. ..... 252/392; 210/749; 106/14.05; 106/14.15; 422/12

[58] Field of Search ..... 252/392, 387, 180, 181; 427/367; 260/584 R, 573, 570.9, 585 R, 585 B; 106/14.05, 14.15; 422/12–14; 210/58–60

[56] References Cited

U.S. PATENT DOCUMENTS

| | | | |
|---|---|---|---|
| 2,541,088 | 2/1951 | Nihawitz | 260/584 |
| 3,441,612 | 4/1969 | Drew | 260/584 |
| 3,723,530 | 3/1973 | Goetze et al. | 260/584 |
| 3,872,116 | 3/1975 | Gipson | 252/392 |

*Primary Examiner*—J. L. Barr

*Attorney, Agent, or Firm*—Hammond & Littell, Weissenberger and Muserlian

[57] ABSTRACT

Mixtures of vicinal aminoalkanols of the formula

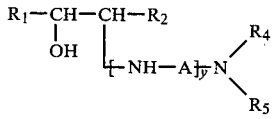

wherein $R_1$ and $R_2$ are alkyl having from 1 to 21 carbon atoms and the sum of the carbon atoms in $R_1+R_2$ is from 6 to 22, A is a member selected from the group consisting of alkylene having from 2 to 6 carbon atoms and methylalkylene having from 3 to 7 carbon atoms, y is an integer from 1 to 3, $R_4$ and $R_5$ are members selected from the group consisting of hydrogen, alkyl having from 1 to 4 carbon atoms and hydroxyalkyl having from 2 to 4 carbon atoms, and their salts with organic carboxylic acids, said mixtures having at least two different adjacent chain lengths of

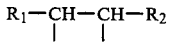

in the range of from 8 to 24 carbon atoms with the proviso that the vicinal substituents are distributed statistically; as well as their process of preparation and their application as corrosion inhibitors.

6 Claims, No Drawings

MIXTURES OF VICINAL AMINOALKANOLS, PROCESS OF PREPARATION, AND THEIR APPLICATION AS CORROSION INHIBITORS

OBJECTS OF THE INVENTION

An object of the present invention is the production of mixtures of vicinal aminoalkanols selected from the group consisting of (1) compounds having the formula

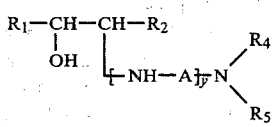

wherein $R_1$ and $R_2$ are alkyl having from 1 to 21 carbon atoms and the sum of the carbon atoms in $R_1+R_2$ is from 6 to 22, A is a member selected from the group consisting of alkylene having from 2 to 6 carbon atoms and methylalkylene having from 3 to 7 carbon atoms, y is an integer from 1 to 3, and $R_4$ and $R_5$ are individually members selected from the group consisting of hydrogen, alkyl having from 1 to 4 carbon atoms and hydroxyalkyl having from 2 to 4 carbon atoms, and (2) their organic carboxylic acid salts, said mixtures having at least two different and adjacent chain lengths of

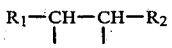

in the range of from 8 to 24 carbon atoms with the proviso that the vicinal amino and hydroxyl substituents are distributed statistically.

Another object of the present invention is the process for the production of the above mixtures of vicinal aminoalkanols consisting essentially of reacting (1) a mixture of epoxidized monoolefins having the formula

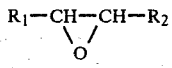

wherein $R_1$ and $R_2$ are alkyl having from 1 to 21 carbon atoms and the sum of $R_1+R_2$ is from 6 to 22, said mixture having at least two different and adjacent chain lengths of

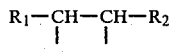

in the range of from 8 to 24 carbon atoms with the proviso that the epoxide groups are distributed statistically, with (2) an excess of an amine of the formula

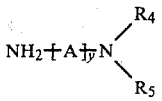

wherein A is a member selected from the group consisting of alkylene having from 2 to 6 carbon atoms and methylalkylene having from 3 to 7 carbon atoms, $R_4$ and $R_5$ are individually members selected from the group consisting of hydrogen, alkyl having from 1 to 4 carbon atoms and hydroxyalkyl having from 2 to 4 carbon atoms, and y is an integer from 1 to 3, in the liquid phase at a temperature of from 100° C. to 230° C. and optionally in the presence of from 0 to 1 mol, based on the amount of said mixture of epoxidized monoolefins, of a catalytically-acting solvent, and recovering said mixture of vicinal aminoalkanols.

A further object of the present invention is the development of a process for the prevention of corrosion of iron-containing metals in the presence of moisture comprising treating them with an effective amount of the above mixture of vicinal aminoalkanols, as well as the corrosion-treating compositions.

These and other objects of the present invention will become more apparent as the description thereof proceeds.

DESCRIPTION OF THE INVENTION

The above objects have been achieved by the development of aminoalkanols of the formula I

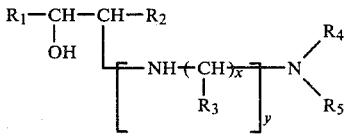

I wherein $R_1$ and $R_2$ denote alkyls with 1 to 21 carbon atoms, and the sum of the carbon atoms in $R_1$ and $R_2$ is 6 to 22, $R_3$ denotes hydrogen or a methyl group, but not more than one methyl radical per alkylene grouping, the radicals $R_4$ and $R_5$ can be identical or different, and denote hydrogen, alkyl with 1 to 4 carbon atoms or hydroxyalkyl with 2 to 4 carbon atoms, x can assume values from 2 to 6, and y values of 1, 2 or 3, in the form of mixtures, depending on the production process, with different chain lengths of 8 to 24 carbon atoms, and the proviso that the vicinal substituents are distributed statistically over the chain; and their salts.

More particularly, the present invention relates to mixtures of vicinal aminoalkanols selected from the group consisting of (1) compounds having the formula

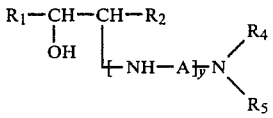

wherein $R_1$ and $R_2$ are alkyl having from 1 to 21 carbon atoms and the sum of the carbon atoms in $R_1+R_2$ is from 6 to 22, A is a member selected from the group consisting of alkylene having from 2 to 6 carbon atoms and methylalkylene having from 3 to 7 carbon atoms, y is an integer from 1 to 3, and $R_4$ and $R_5$ are individually members selected from the group consisting of hydrogen, alkyl having from 1 to 4 carbon atoms and hydroxyalkyl having from 2 to 4 carbon atoms, and (2) their organic carboxylic acid salts, said mixtures having at least two different and adjacent chain lengths of

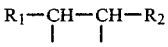

in the range of from 8 to 24 carbon atoms with the proviso that the vicinal amino and hydroxyl substituents are distributed statistically.

In the preparation of the vicinal aminoalkanol mixtures according to the invention, mixtures of olefins with 8 to 24 carbon atoms containing statistically distributed non-terminal double bonds are employed as starting materials for the synthesis. These olefin mixtures are known per se and can be obtained, for example, by catalytic dehydration or by chlorination/dehydrochlorination of paraffins having 8 to 24 carbon atoms and selective extraction of the non-terminal monoolefins obtained. However, it is also possible to use mixtures of such olefins with saturated hydrocarbons, as they are obtained in the preparation of these olefins. Preferred as mixtures of isomeric monoolefins are the fractions with a high content of linear $C_{11-14}$ olefins or $C_{15-18}$ olefins. The particularly preferred mixtures of non-terminal olefins have the following chain length distribution:

| | |
|---|---|
| (a) Fraction $C_{11-14}$ olefins (distribution in % by weight) | |
| $C_{11}$ Olefins | About 22 |
| $C_{12}$ Olefins | About 30 |
| $C_{13}$ Olefins | About 26 |
| $C_{14}$ Olefins | About 22 |
| (b) Fraction $C_{15}$–$C_{18}$ olefins | |
| $C_{15}$ Olefins | About 26 |
| $C_{16}$ Olefins | About 35 |
| $C_{17}$ Olefins | About 31 |
| $C_{18}$ Olefins | About 6 |

The above preferred mixtures of $C_{11}$–$C_{14}$ olefins and $C_{15}$–$C_{18}$ olefins can also have deviations in the indicated chain length distributions.

For the preparation of the products according to the invention, the olefin mixtures are epoxidized by means of known methods, for example, with peracetic acid. In the process of the present invention, these non-terminal olefin epoxide mixtures are reacted with amines of the general formula II:

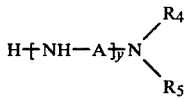

II wherein A is a member selected from the group consisting of alkylene having from 2 to 6 carbon atoms and methylalkylene having from 3 to 7 carbon atoms, y is an integer from 1 to 3, and $R_4$ and $R_5$ are individually members selected from the group consisting of hydrogen, alkyl having from 1 to 4 carbon atoms and hydroxyalkyl having from 2 to 4 carbon atoms. This reaction yields the vicinal aminoalkanol mixtures according to the invention.

Suitable amine compounds for the reaction are for example:

ethylene diamine
1,3-propylene diamine
hexamethylene diamine
N-methyl-1,2-propylene diamine
N,N-diethylethylene diamine
N,N-dimethyl-1,3-propylene diamine
N-propylhexamethylene diamine
N-ethylol-ethylene diamine
N,N-diethylol-ethylene diamine
diethylene triamine
di-1,3-propylene triamine
di-1,2-propylene triamine
di-hexamethylene triamine
N,N-dimethyl-diethylene triamine
N-ethyl-di-1,3-propylene triamine
triethylene tetramine.

The amines are used in from 1.0 to 15 times the molar amount, based on the epoxide mixture and can serve at the same time as solvents, provided they are liquid at room temperature. If necessary, an additional catalytically-acting solvent can be used, preferably water, water-miscible lower alkanols, such as ethanol, water-miscible lower alkylene glycols, such as ethylene glycol or glycerin, or mixtures thereof.

The reaction between the olefin epoxide and the amine is carried out in a temperature range of 100° to 230° C., preferably, at the reflux temperature of the amine or solvent used. If the boiling point of the diamine or triamine is below the required reaction temperature, or if a low-boiling catalytically acting solvent is to be used, the reaction can also be carried out in the autoclave at temperatures of 150° to 230° C. under pressure.

According to a preferred embodiment, the reaction with amines, where in Formula II, $R_4$ and $R_5$ are other than hydrogen, is also carried out under pressure if their boiling point is below the desired reaction temperature. The epoxide mixture is then charged with an amount of 0.1 to 0.5 mol of glycerin or ethylene glycol, based on the epoxide mixture, at a reaction temperature of 150° to 220° C., and the low boiling diamine is added slowly in an 1.0 to 1.5 molar amount, based on the epoxide mixture used, so that the temperature does not drop more than 10° to 20° C. below the initially set reaction temperature. Subsequently the mixture can be stirred for 1 to 2 hours at reflux temperature. The catalytically-acting solvent is washed out with water or distilled off after the reaction.

The time required for the reaction can vary within a wide range, and usually takes about 1 to 50 hours, preferably 1 to 5 hours.

The working up of the reaction mixture can be effected according to known methods, for example, by distillation.

The amine salts of the mixtures of vicinal aminoalkanols with acids, particularly aliphatic carboxylic acids with 2 to 24 carbon atoms, such as alkanoic acids, for example, acetic acid, lauric acid, stearic acid; alkenoic acids, for example, lauroleic acid, oleic acid, and hydroxyalkanoic acids, for example, lactic acid, can be produced, if necessary, according to known methods, by neutralizing the aminoalkanol mixtures.

The aminoalkanol mixtures according to the invention are suitable as corrosion inhibitor additives in fuels, oils and lubricants. They can also be used as solutions in organic solvents, and surprisingly also in water, particularly as 0.1% to 10% by weight solutions, as corrosion inhibitors.

Compared to the natural fatty amines otherwise used as corrosion inhibitors, the products according to the invention show a much better inhibiting action and are also easier to dose, because of their low solidification temperatures.

Another advantage of the invention is that the application of the vicinal aminoalkanol mixtures is much simpler, compared to the natural products, because they have only a weak amine odor and they are some compatible with the skin. Therefore, they may be employed as corrosion inhibitors in cutting oils and as coating agents for metals handled by humans.

The subject of the invention is described more fully below on the basis of production methods and examples without limiting it, however, in any way to these methods and examples.

EXAMPLES

General Description of the Preparation of the Aminoalkanols

The designations $C_{11}$–$C_{14}$ epoxide and $C_{15}$–$C_{18}$ epoxide used in the examples designate the above-described epoxides of mixtures of olefins with statistically distributed nonterminal double bonds and the chain length distributions. The aminoalkanol mixtures obtained by the reaction of epoxide mixtures with amine according to Example 1 are compiled in following Table I.

TABLE I

| Epoxide | Amine | Product |
|---|---|---|
| $C_{11}$–$C_{14}$ | Ethylene diamine | A |
| $C_{15}$–$C_{18}$ | Ethylene diamine | B |
| $C_{11}$–$C_{14}$ | 1,3-Propylene diamine | C |
| $C_{15}$–$C_{18}$ | 1,3-Propylene diamine | D |
| $C_{11}$–$C_{14}$ | 1,2-Propylene diamine | E |
| $C_{15}$–$C_{18}$ | 1,2-Propylene diamine | F |
| $C_{11}$–$C_{14}$ | Hexamethylene diamine | G |
| $C_{15}$–$C_{18}$ | Hexamethylene diamine | H |
| $C_{11}$–$C_{14}$ | Diethylene triamine | I |
| $C_{15}$–$C_{18}$ | Diethylene triamine | K |
| $C_{11}$–$C_{14}$ | N,N-Dimethyl-1,3-propylene diamine | L |
| $C_{15}$–$C_{18}$ | N,N-Dimethyl-1,3-propylene diamine | M |
| $C_{11}$–$C_{14}$ | N-ethylol-ethylene diamine | N |
| $C_{15}$–$C_{18}$ | N-ethylol-ethylene diamine | O |

EXAMPLE 1

A mixture of 198 gm (about 1 mol) of a $C_{11}$–$C_{14}$ epoxide was stirred in a 2-liter three-necked flask equipped with thermometer, reflux condenser and stirrer, with 480 gm (8 mols) of ethylene diamine for 24 hours at reflux temperature. Subsequently, the excess ethylene diamine was distilled off under atmospheric pressure. The $C_{11}$–$C_{14}$ vicinal hydroxy diamine, Product A, was separated by distillation from higher boiling components. The yield is 220 gm of Product A, corresponding to 88% theory.

Boiling range—129° to 133° C./0.1 torr
Index of refraction at 20° C.—1.4688
Amine number—Found 444, Calculated 448.

The products listed in Table II were also produced according to Example 1.

TABLE II

| Product | Mols Epoxide | Mols Amine | Reaction Time (H) | Reaction Temp. °C. | Yield % | Boiling Range °C./0.1 Torr. | Index of Refraction at 20° C. | Amine Number Found | Amine Number Calc. |
|---|---|---|---|---|---|---|---|---|---|
| B | 1 | 8 | 5 | 115–130 | 85 | 148–155 | 1,4688 | 362 | 371 |
| E | 1 | 8 | 5 | 120–130 | 87 | 135–152 | — | 409 | 424 |
| F | 1 | 8 | 5 | 120–130 | 89 | — | — | 334 | 354 |
| G | 1 | 7 | 4 | 190–200 | 87 | 138–188 | — | 342 | 365 |
| H | 1 | 12 | 5 | 190–200 | 93 | — | — | 297 | 312 |
| I | 1 | 6 | 3 | 200–210 | 84 | 143–185 | — | — | 572 |
| K | 1 | 6 | 3 | 200–210 | 82 | — | — | — | 487 |
| N | 1 | 1.5 | 4 | 200–230 | 81 | 165–200 | 1,4770 | 351 | 378 |
| O | 1 | 1.5 | 4 | 200–230 | 85 | 187–230 | 1,4754 | 290 | 322 |

The symbol "—" indicates value not determined.

EXAMPLE 2

A mixture of 255 gm (about 1 mol) of $C_{15}$–$C_{18}$ epoxide and 590 gm (8 mols) of 1,3-propylene diamine was stirred in a 3-liter lifting-and-stirring steel autoclave for one hour at 200° C. A maximum pressure of 5 to 10 atm. was obtained. After the reaction was completed, the excess propylene diamine was distilled off and the Product D obtained was fractioned. The yield was 295 gm of Product D, corresponding to 94% of the theory.

Boiling range—158° to 163° C./0.1 torr
Index of refraction at 20° C.—1.4694
Amine number—Found 350, Calculated 354.

The products indicated in the following Table III were obtained in the autoclave under pressure without a catalytically-active solvent according to the method described in Example 2.

TABLE III

| Product | Mols Epoxide | Mols Amine | Reaction Time (h) | Reaction Temp. °C. | Maximum Pressure Atm. | Yield % | Boiling Range °C./0.1 Torr. | Index of Refraction at 20° C. | Amine Number Found | Amine Number Calc. |
|---|---|---|---|---|---|---|---|---|---|---|
| A | 1 | 8 | 1 | 200 | 10–20 | 95 | 129–133 | 1.4688 | 444 | 448 |
| B | 1 | 8 | 1 | 200 | 10–20 | 94 | 148–155 | 1.4688 | 362 | 371 |
| C | 1 | 6 | 1 | 200 | 5–10 | 90 | 132–135 | 1.4692 | 425 | 424 |
| E | 1 | 6 | 1 | 200 | 5–10 | 90 | — | — | 405 | 424 |

The symbol "—" indicates value not determined.

EXAMPLE 3

A mixture of 255 gm (about 1 mol) of $C_{15}$–$C_{18}$ epoxide, 612 gm (6 mols) of N,N-dimethyl-1,3-propylene diamine and 9 gm (0.5 mol) of water was stirred in a 3-liter lifting-and-stirring steel autoclave for 5 hours at 200° C. A maximum pressure of 25 to 30 atm. was obtained. After the reaction, the excess diamine was distilled off and the product was purified. The yield was 305 gm of Product M, corresponding to 85% of theory.

Boiling range—135° to 179° C./0.15 torr
Index of refraction at 20° C.—1.4513
Amine number—Found 312, Calculated 325.

Other aminoalkanol mixtures according to the invention which were prepared in the autoclave with the addition of water, as described in Example 3 above, are compiled in Table IV.

TABLE IV

| Product | Mols Epoxide | Mols Amine | Mols Catalyst Solvent | Reaction Time (h) | Reaction Temp. °C. | Maximum Pressure Atm. | Yield % | Boiling Range °C./0.1 torr | Index of Refraction at 20° C. | Amine Number Found | Amine Number Calc. |
|---|---|---|---|---|---|---|---|---|---|---|---|
| A | 1 | 6 | 0.2 water | 1 | 200 | 25-30 | 88 | 129-133 | 1.4688 | 444 | 448 |
| B | 1 | 6 | 0.2 water | 1 | 200 | 25-30 | 87 | 148-155 | 1.4688 | 362 | 371 |
| L | 1 | 6 | 0.5 water | 5 | 200 | 25-30 | 87 | 110-173 | 1.4593 | 372 | 384 |

EXAMPLE 4

198 gm (about 1 mol) of $C_{11}$-$C_{14}$ epoxide, 18 gm (0.2 mol) of glycerin, and a few drops of N,N-dimethyl-1,3-propylene diamine were stirred magnetically in a 1-liter, 3-necked flask with a dropping funnel, a reflux condenser and a thermometer at 200° C. Then 112 gm (1.1 mol) of N,N-dimethyl-1,3-propylene diamine were added slowly in drops so that the temperature doesn't drop below 190° C. Subsequently the stirring was continued for 2 hours at the reflux temperature (200° to 210° C.) and the glycerin was washed out with water. The Product L was purified by distillation, and a yield of 258 gm of Product L was obtained, corresponding to 89% of the theory.

Index of refraction at 20° C.—1.4593

Amine number—Found 372, Calculated 384.

According to the same method the $C_{15}$-$C_{18}$ epoxide mixture was reacted with N,N-dimethyl-1,3-propylene diamine to give Product M.

Yield of Product M—320 gm, 93% of theory

Index of refraction at 20° C.—1.4513

Amine number—Found 310, Calculated 325.

EXAMPLE 5 to 8

Application of the Aminoalkanol Mixtures

The corrosion inhibiting tests were made with Products A to O and the Amine Salts P to W. The amine salts were prepared by stirring the corresponding aminoalkanol mixtures and organic acids together.

(P) $C_{11}$-$C_{14}$ ethylene diamine-alkanol dilactate
(Q) $C_{15}$-$C_{18}$ ethylene diamine-alkanol dilactate
(R) $C_{11}$-$C_{14}$ ethylene diamine-alkanol dioleate
(S) $C_{15}$-$C_{18}$ ethylene diamine-alkanol dioleate
(T) $C_{11}$-$C_{14}$ 1,3-propylenediamine-alkanol dilactate
(U) $C_{15}$-$C_{18}$ 1,3-propylenediamine-alkanol dilactate
(V) $C_{11}$-$C_{14}$ 1,3-propylenediamine-alkanol dioleate
(W) $C_{15}$-$C_{18}$ 1,3-propylenediamine-alkanol dioleate The following products were included in the tests for comparison:

(X) N-dodecyl-1,3-propylene diamine
(Y) distilled tallowamine (an amine derived from tallow fatty acids)
(Z) distilled coconutamine (an amine derived from coconut fatty acids)

The tests were carried out with an aqueous solution and with a solution in test benzine, as far as the products were soluble in both media.

EXAMPLE 5

The products, which were water-soluble or at least easily dispersible in water in emulsion form, were tested according to the filter paper-corrosion test IP 287 T. In this test filter papers (diameter 9 cm) were coated with 3 gm of grey iron chips GG 20 and wetted with 3 ml of a 2% solution of the test substances in distilled water. The samples were covered, left standing for 2 hours at room temperature, and subsequently the filter paper was liberated of the grey iron chips and dried. The evaluation was visual on the basis of rust stains, compared to a blank test. The results of the test are shown in Table V.

TABLE V

Corrosion Protection Test in Aqueous Solution

| Product | Rust Stains in % Compared to Blank Test Sample |
|---|---|
| Blank value | 100% |
| A | 5 to 10% |
| B | 0 to 5% |
| C | 5 to 10% |
| D | 5 to 10% |
| I | 10 to 15% |
| K | 10 to 15% |
| X | 100% |
| Y | 100% |
| Z | 90 to 100% |

Table V shows the good corrosion-inhibiting effect of the vicinal aminoalkanol mixtures according to the invention, particularly of the $C_{15}$-$C_{18}$ ethylene diamine alkanol mixture mixture (Product B).

EXAMPLE 6

The oil-soluble substances were tested according to the static water drop test (see Baker et al, Ind. Eng. Chem. 41, 137 [1949]). Equilateral triangles of steel (RRST 1403 m) with a side length of 45 mm and with the corners bent down obliquely, which had in the center of the triangular surface a circular depression of 19 mm diameter, served as test pieces. These steel pieces were coated with a 2% solution of the test substance dissolved in test benzine. After draining, 3 drops of a 3% physiological salt solution were placed in the depression of the test pieces. The results were evaluated by visual determination of the amount of rust formed, compared to a blank value. The results of the test are shown in Table VI.

TABLE VI

Corrosion Tests in White Spirit Solution

| Product | Amount of Rust in % Compared to Blank Value After 1 Day | After 2 Days |
|---|---|---|
| Blank value | 100% | 100% |
| A | 0 | 5 |
| B | 0 | 0 |
| C | 10 | 10 |
| D | 0 | 0 |
| G | 10 | 15 |
| H | 0 | 0 |
| I | 10 | 10 |
| K | 0 | 5 |
| L | 10 | 15 |
| M | 0 | 5 |
| N | 0 | 10 |
| O | 0 | 0 |

TABLE VI-continued

| Corrosion Tests in White Spirit Solution | | |
|---|---|---|
| | Amount of Rust in % Compared to Blank Value | |
| Product | After 1 Day | After 2 Days |
| P | 15 | 15 |
| Q | 10 | 10 |
| R | 0 | 0 |
| S | 0 | 0 |
| T | 15 | 20 |
| U | 10 | 10 |
| V | 0 | 0 |
| W | 0 | 0 |
| X | 70 | 100 |
| Y | 50 | 70 |
| Z | 60 | 90 |

The aminoalkanol mixtures prepared from $C_{15}$–$C_{18}$ epoxide and all tested oleates show a particularly good corrosion inhibiting effect.

EXAMPLE 7

The test for corrosion protection in a hydrochloric acid medium was made by determining the "acid protection number" (according to Nottes; Erdoel u. Kohle, 15, 640 [1962]). To this end five test strips (100×10×1 mm) were exposed, after careful cleaning to the acid attack (0.5 N hydrochloric acid) at 70° C. for one hour. The sum of the weight losses forms the blank value. After adding 0.1% of the substances to be tested, the test is repeated with the same test strips. The weight loss is determined as the test value. The so-called acid protection number (APN) is defined as:

$$APN = \frac{(\text{Blank value} - \text{test value}) \times 100}{\text{blank value}}$$

The higher the acid protection number of a substance, the better is its acid protection. The results of the test are shown in Table VII.

TABLE VII

| Acid Protection Number | |
|---|---|
| Product | APN |
| A | 85 |
| B | 84 |
| C | 81 |
| D | 80 |
| I | 82 |
| K | 83 |
| N | 86 |
| O | 87 |
| X | 76 |
| Y | 78 |

EXAMPLE 8

The test of the local compatibility of the aminoalkanol mixture was made by dropping a small amount of 2.5% solutions of the test substances in olive oil once into the conjunctival sac of one eye of groups of albino rabbits.

The reactions of the ocular mucosa were evaluated according to a point system by Draize (Appraisal of the Safety of Chemicals in Foods, Drugs and Cosmetics, Assoc. of Food and Drug Officials of the U.S., pp. 49–52 [1959]), at 2 hours, and 2, 4, 6 and 8 days after the application. The results of the mucosa compatibility test can be seen from Table VIII.

TABLE VIII

| Product | Concentration | Compatibility |
|---|---|---|
| A | 2.5% | Moderate conjunctival reaction after 4 days negative. |
| B | 2.5% | Moderate, conjunctival reaction, after 4 days negative |
| C | 2.5% | Strong conjunctival reaction, after 6 days negative. |
| D | 2.5% | Moderate conjunctival reaction, after 4 days almost gone. |
| L | 2.5% | Moderate conjunctival reaction, after 24 hours negative. |
| X | 1% | Strong conjunctival reaction, after 8 days still 30 to 40% of the maximum reaction |

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. Mixtures of vicinal aminoalkanols selected from the group consisting of (1) compounds having the formula:

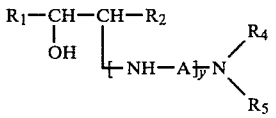

wherein $R_1$ and $R_2$ are alkyl and the sum of the carbon atoms in $R_1$ and $R_2$ is from 13 to 16, A is a member selected from the group consisting of alkylene having from 2 to 6 carbon atoms and methylalkylene having from 3 to 7 carbon atoms, y is an integer from 1 to 3, and $R_4$ and $R_5$ are individually members selected from the group consisting of hydrogen, alkyl having from 1 to 4 carbon atoms and hydroxyalkyl having from 2 to 4 carbon atoms, and (2) their organic carboxylic acid salts, said mixtures having at least two different and adjacent chain lengths of

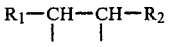

with the proviso that the vicinal amino and hydroxyl substituents are distributed statistically over the chain length.

2. The mixtures of vicinal aminoalkanols of claim 1 wherein said vicinal aminoalkanols are derived from ethylene diamine.

3. The mixtures of vicinal aminoalkanols of claim 1 wherein said vicinal aminoalkanols are derived from 1,3-propylene diamine.

4. The mixtures of vicinal aminoalkanols of claim 1 wherein said vicinal aminoalkanols are derived from an amine selected from the group consisting of hexamethylene diamine, diethylene triamine, N,N-dimethyl-1,3-propylene diamine and N-ethylol-ethylene diamine.

5. Corrosion inhibiting compositions consisting essentially of from 0.1% to 10% by weight of said mixtures of vicinal aminoalkanols of claim 1 in a solvent media selected from the group consisting of water and organic solvents.

6. In the method of preventing corrosion of iron containing metals which comprises applying a coating of a corrosion inhibitor to the surface of said metals, the improvement consisting of utilizing the mixtures of vicinal aminoalkanols of claim 1, as said corrosion inhibitor.

* * * * *

UNITED STATES PATENT AND TRADEMARK OFFICE

CERTIFICATE OF CORRECTION

PATENT NO. : 4,302,354

DATED : November 24, 1981

INVENTOR(S) : WOLFGANG GEIDE et al.

It is certified that error appears in the above—identified patent and that said Letters Patent is hereby corrected as shown below:

On the Preamble page, in item [73] the second assignee should read:

-- Deutsch Gold- und Silber-Scheideanstalt vormals Roessler --.

Signed and Sealed this

*Thirtieth* Day of *March 1982*

[SEAL]

*Attest:*

GERALD J. MOSSINGHOFF

*Attesting Officer*

*Commissioner of Patents and Trademarks*